US008678701B1

(12) United States Patent
Aldasem

(10) Patent No.: US 8,678,701 B1
(45) Date of Patent: Mar. 25, 2014

(54) SYSTEM FOR REMOTE CONTROL OF RETRACTABLE, GROUND-BASED VEHICLE BARRIERS

(71) Applicant: Farraj J. A. Aldasem, Jahra (KW)

(72) Inventor: Farraj J. A. Aldasem, Jahra (KW)

( * ) Notice: Subject to any disclaimer, the term of this patent is extended or adjusted under 35 U.S.C. 154(b) by 0 days.

(21) Appl. No.: 13/903,921

(22) Filed: May 28, 2013

(51) Int. Cl.
*E01F 13/00* (2006.01)
*E01F 15/00* (2006.01)

(52) U.S. Cl.
USPC ..... 404/72; 404/6; 404/9; 404/10; 404/11; 256/13.1

(58) Field of Classification Search
USPC ..... 404/6, 9–11, 72; 256/13.1
See application file for complete search history.

(56) References Cited

U.S. PATENT DOCUMENTS

| | | | | |
|---|---|---|---|---|
| 4,690,583 | A * | 9/1987 | Faulconer | 404/6 |
| 4,752,152 | A | 6/1988 | Crisp et al. | |
| 4,901,071 | A | 2/1990 | Fletcher | |
| 4,919,563 | A | 4/1990 | Stice | |
| 5,959,554 | A | 9/1999 | Armstrong et al. | |
| 6,150,958 | A | 11/2000 | Worsham | |
| 7,001,099 | B2 | 2/2006 | Rittenhouse et al. | |
| 7,641,416 | B2 * | 1/2010 | Miracle | 404/6 |
| 2002/0090259 | A1 * | 7/2002 | Crowley et al. | 404/6 |
| 2004/0033106 | A1 | 2/2004 | Turpin et al. | |
| 2010/0247238 | A1 | 9/2010 | Goodman et al. | |
| 2012/0044046 | A1 | 2/2012 | Al-Jafar | |
| 2012/0243936 | A1 * | 9/2012 | Slagel | 404/6 |
| 2013/0045047 | A1 | 2/2013 | Morgan et al. | |

FOREIGN PATENT DOCUMENTS

| | | |
|---|---|---|
| DE | 2 048 780 | 4/1972 |
| DE | 10 2006 005 022 B3 | 6/2007 |
| FR | 2 922 907 | 5/2009 |

* cited by examiner

*Primary Examiner* — Raymond W Addie
(74) *Attorney, Agent, or Firm* — Richard C. Litman

(57) ABSTRACT

The system for remote control of retractable, ground-based vehicle barriers increases control of the emergency lane of the road by mounting ground signboards in the emergency lane to prevent any vehicle to pass through this lane and so the police vehicle or the ambulance can easily and quickly approach the site of accident through the emergency lane. The signboards include a U-shaped frame permanently mounted in the emergency lane and a panel pivotally attached to the frame. Servo motors are provided to rotate the panels between a vertical position providing a barrier to traffic and a horizontal position permitting an emergency response vehicle to travel through the emergency lane. The emergency response vehicle is provided with a remote control unit having a short-range transmitter that transmits a trigger signal that is received by a unit at the barrier sign to activate a motor controller to lower the sign.

15 Claims, 5 Drawing Sheets

SYSTEM FOR REMOTE CONTROL OF RETRACTABLE, GROUND-BASED VEHICLE BARRIERS

BACKGROUND OF THE INVENTION

1. Field of the Invention

The present invention relates to vehicular traffic control, and particularly to a system for the remote control of retractable, ground-based vehicle barriers.

2. Description of the Related Art

Today, worldwide highway and road traffic flow control is typically done independently and visually on an intersection-by-intersection basis using age-old magnetometer vehicle detection coupled with timed signal lights. Government agencies are aware of the increased safety and resulting cost saving potentials associated with making highways more intelligent. More informed and aware drivers will result in fewer traffic accidents, which, in turn, results in less emergency response calls, less insurance claims, and great cost savings. Thousands of people die or are seriously injured from traffic accidents when they could have been saved or had better outcomes if emergency services had arrived just a few minutes earlier. In addition, multiple vehicle accidents often occur because of the lack of warning of impending danger ahead from accidents or stopped traffic.

One approach that has been utilized is the use of portable and fixed programmable signs that are placed along the roadside. Although, a portable sign can sometimes be quickly dispatched to an accident scene, doing so nevertheless takes a significant amount of time.

Also, as is well known, emergency vehicles, such as the police, fire, medical, or other emergency responders that need to go as quickly as possible, especially in emergencies, to the site of the emergency.

It is desirable that a vehicle used by the police and/or emergency services have a disability-free emergency lane available, so that the risk of delays to reach the place of use is at least reduced, thereby increasing the chance of survival for a victim.

Thus, a system for the remote control of retractable, ground-based vehicle barriers solving the aforementioned problems is desired.

SUMMARY OF THE INVENTION

The system for remote control of retractable, ground-based vehicle barriers increases control of the emergency lane of the road by mounting ground signboards in the emergency lane to prevent any vehicle to pass through this lane and so the police vehicle or the ambulance can easily and quickly approach the site of accident through the emergency lane. The signboards include a U-shaped frame permanently mounted in the emergency lane and a panel pivotally attached to the frame. Servo motors are provided to rotate the panels between a vertical position providing a barrier to traffic and a horizontal position permitting an emergency response vehicle to travel through the emergency lane. The emergency response vehicle is provided with a remote control unit having a short-range transmitter that transmits a trigger signal that is received by a unit at the barrier sign to activate a motor controller to lower the sign. The signs may be equipped with transceivers that sequentially relay the trigger signal to a series of such sign barriers to lower the barriers.

Thus, in a first embodiment, the system and method and system relate to remotely controlling ground surface signboards, and particularly to signboards in an emergency lane of the road.

In another embodiment, the system may be used for controlling a signboard for private parking for disabled persons' vehicles to prevent unauthorized use of the parking space. It is possible to fix remote control unit in the disabled person's car so that the device operates only through a biometric sensor and identifier that verifies the identity of the disabled person authorized to use the space. The biometric sensor may be a fingerprint sensor, a voiceprint sensor, an iris or retinal sensor, or the like. When the disabled person drives that car and wishes to access the parking space, he or she may receive a voice message on his mobile phone to activate the device. The disabled person then activates a remote control device having the biometric sensor, and upon verification of identity, the remote control activates a motor controller to lower the signboard barrier mounted in the disabled person's parking space. Even if this car is stolen, the control unit doesn't work for anyone other than the disabled person, so that the parking space is preserved.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
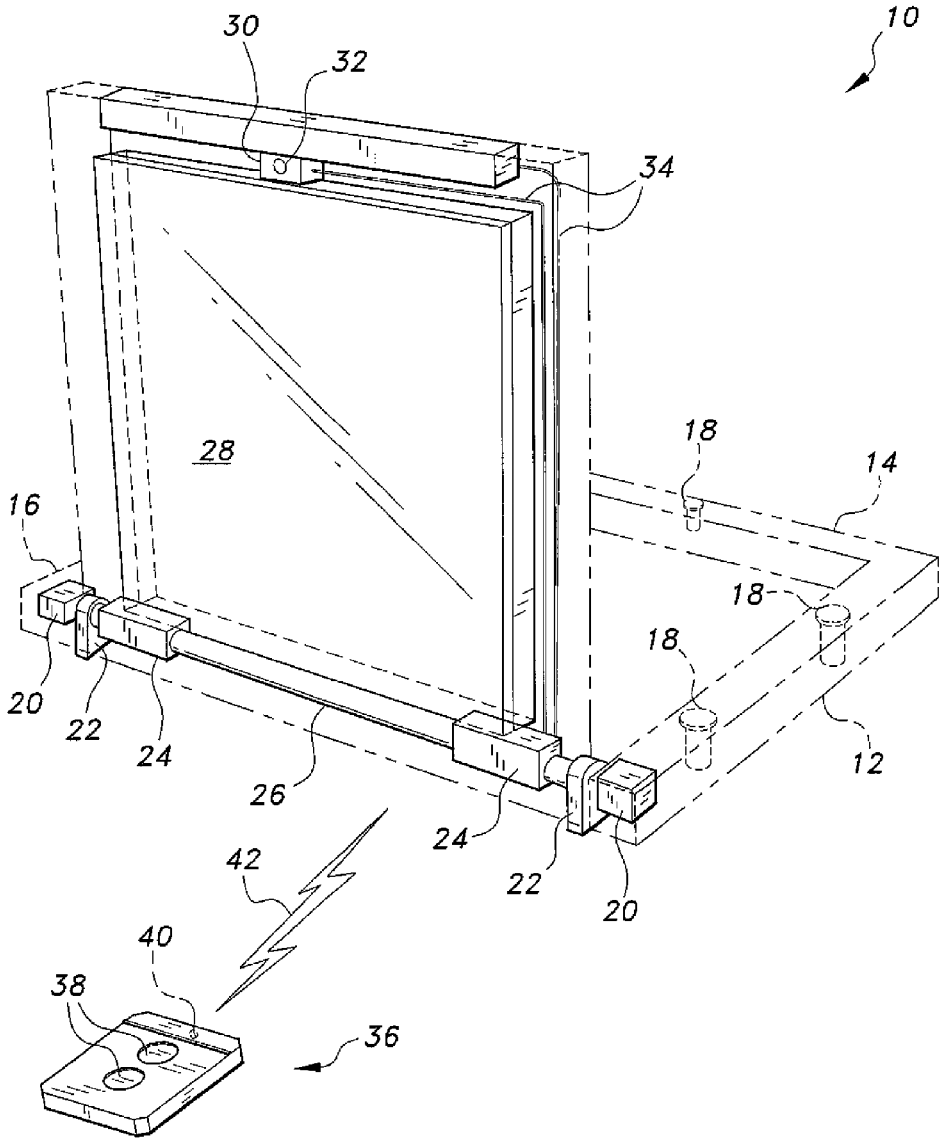
FIG. 1 is a perspective view of a system for remote control of retractable, ground-based vehicle barriers according to the present invention, showing the barrier in a raised position.

The system for remote control of retractable, ground-based vehicle barriers may be described as follows. The ground signboard comprises a base, which is mounted and fixed in the road surface; a signboard external frame, which is covered by a reflective sheet or that may be painted with an electroluminescent, fluorescent, or other reflective paint; a signboard face body, which is used to indicate the appropriate sign, e.g., police, ambulance vehicle, or handicapped sign or private parking; and a pivotally mounted rod or shaft, which connects the signboard external frame with the base. The pivotal rod is attached to the base by a hinge. The signboard is rotated and moved up and down by a motor mounted in or on the rod. The motion of the signboard is triggered when the receiving unit receives a signal from the authorized vehicle to lower the signboard so that the authorized vehicle can pass above the board. The signboard also has power supply outlet, which activates the signboard to work. The signboard can also operate by solar power, storing the electric power in a rechargeable battery.

In the first embodiment, the signboard is mounted in the emergency lane of a roadway or highway, and its normal state is substantially vertical, but may be at an angle of about 88° to the ground, which enables the signboard to rotate down by its weight and reach the ground surface if it has a problem or the source of power is shut down. So, in the normal case, an unauthorized vehicle can't go through or move across the emergency lane. In case of an emergency, such as an accident, the police, ambulance vehicle, or other emergency responder receives an order to help the persons in need through their mobile radio system.

The emergency response vehicle is equipped with a remote control device that has a transmitter unit to transmit a signal to the signboard, which has a receiver. The receiver sends a signal to a motor controller to activate the motor to rotate the signboard rod to lower the signboard. The motor 3 is connected to source of power. The remote control device has controls to raise the signboard to vertical, as its normal state, and to move the signboard down to be horizontal to the ground surface. The control unit is fixed on the vehicle, preferably on the dashboard or place conveniently accessible to the driver. The vehicle may be equipped with two remote controls as a redundant safety measure in case of failure of the primary device.

In another embodiment, the remote control unit may have a transmitter unit to transmit a signal to the signboard, controls to raise the signboard to vertical as its normal state and to move the signboard down to be horizontal to the ground surface, a processor, a USB socket to input programming instructions to the processor, a touch pad, screen, or microphone for a biometric sensor (which may be a fingerprint scanner, a voiceprint audio system, a video scanner for iris or retinal scans, or the like).

A distance about 100 to 250 meters may separate or space apart each signboard in the emergency lane. Also, the frequency range of the transmitter in the remote control unit may be about 10 to 100 meters. The authorized person can program the remote control unit as the needs of the road and the highway infrastructure require.

In case of an emergency, such as an accident, the police and ambulance vehicle received an order to help the persons in need. They receive also the location of the accident. In order to approach the accident location, the policemen who drive the police vehicle activate the control unit by his fingerprint (or other biometric data) so that the remote control works automatically and sends signal to the receiver in the signboard. When the signboard receiver receives the appropriate signal, it sends a signal to the motor to rotate clockwise until it is horizontal to the surface of the road, and so the next signboard until the police car reach the accident site. Alternatively, the policeman can automatically control the motion of the signboard manually by activating the appropriate control on the remote control unit, e.g., by pressing a button. After the authorized vehicle passes through the signboard location and the distance becomes, e.g., 1 meter, the signboard rotates to return to its normal position (vertical position) so that the only authorized is allowed to go through the emergency lane to easily and quickly approach the accident and assist the injured persons. The signboard may be made of waterproof metal.

In another embodiment, the system for remotely controlling signboards in the ground may be used for private parking for disabled persons' vehicles, or any other private parking. The remote control unit in the disabled person's vehicle is programmed to start to rotate the signboard in the parking when the distance between the vehicle and the signboard is 2 meters, and to return to its position after the vehicle leaves the parking and the distance is also the same, about 2 meters. Also, the control unit can be programmed to control the signboard by the range of the transmitter signal or the time between the vehicle and the signboard.

Referring to FIG. 1, a system for remote control of retractable, ground-based vehicle barriers, designated generally as 10 in the drawings, includes a base member having a plurality of elongate frame members, including a first frame member 12, a second frame member 14, and a third frame member 16 defining a U-shaped frame. The frame members may contain apertures 18 that extend through their bodies, thereby allowing a fastening device to connect the base member to pavement or any other suitable surface. Preferably, the frame member is mounted in a recess in the road surface so that a vehicle's tires will not be damaged when passing over the frame.

A plurality of hinge members 20 are located within a recess in the opposing first 12 and third 16 elongate frame members. A pair of lugs 22 are positioned next to each hinge member 20 as a securing means. Each lug 22 has an opening journaled therein that allows for a rotating rod or shaft 26 to pass through and connect to the corresponding hinge member 20. The revolution of the rotating rod 26 is generated by a plurality of electric motors 24 that surround the rotating rod 26. The electric motors 24 are activated by a motor controller circuit 34 located in a panel 28 that is fixed to the rod 26 for rotation therewith. The motor controller circuit is activated by a signal from a radio receiver 30 connected to a processor 32. A transmitter from a remote control unit 36 sends out a radio signal 42 to the receiver 30 via an antenna 40. The signal is sent out when a push button among a plurality of buttons 38 is pressed by the user. The buttons 38 can be labeled by any desired indicia to indicate the function of the button 38, such as "On", "Off", "Open", "Close", "Up", "Down", etc. The practice of activating a motor by electrical means connected to a receiver that receives a radio signal sent by a transmitter is well known in the art, as shown in U.S. Pat. No. 4,901,071, which is hereby incorporated by reference in its entirety.

Figure 2:
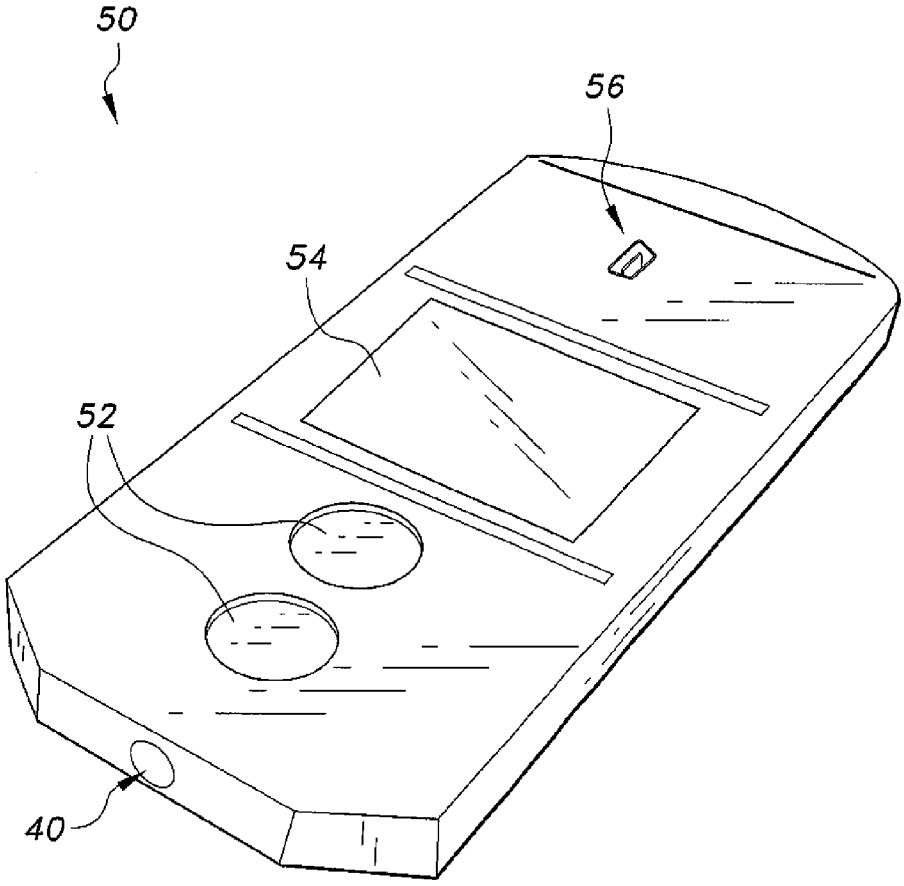
FIG. 2 is a perspective view of an alternative embodiment of a transmitter for a system for remote control of retractable, ground-based vehicle barriers according to the present invention.

An alternative embodiment of a remote control unit 50 is shown in FIG. 2. The body of the remote control unit 50 is larger than the remote control unit 36 of FIG. 1 in order to accompany other types of control devices. In this embodiment, a plurality of buttons 52 are still present. However, a touch pad 54 or scanner screen has been added, along with a USB port 56. The touch pad or scanner screen serves as a biometric sensor for scanning the user's fingerprints, or as an iris or retinal scanner for identification purposes. Alternatively, the device may have a microphone for obtaining an audio sample for voiceprint identification. In this embodiment, the remote control unit 50 would only be activated by a recognized user's fingerprint (or voiceprint, or eye scan data) that has been stored internally and identified by identification or verification software that compares the user's biometric data to the stored copy. The USB socket 56 is utilized by the operator for installing programming into the remote control unit 50, as well as fingerprint and voice data. Regardless of the embodiment, the remote control unit 36, 50 can be handheld or mountable onto a vehicle.

Figure 3:
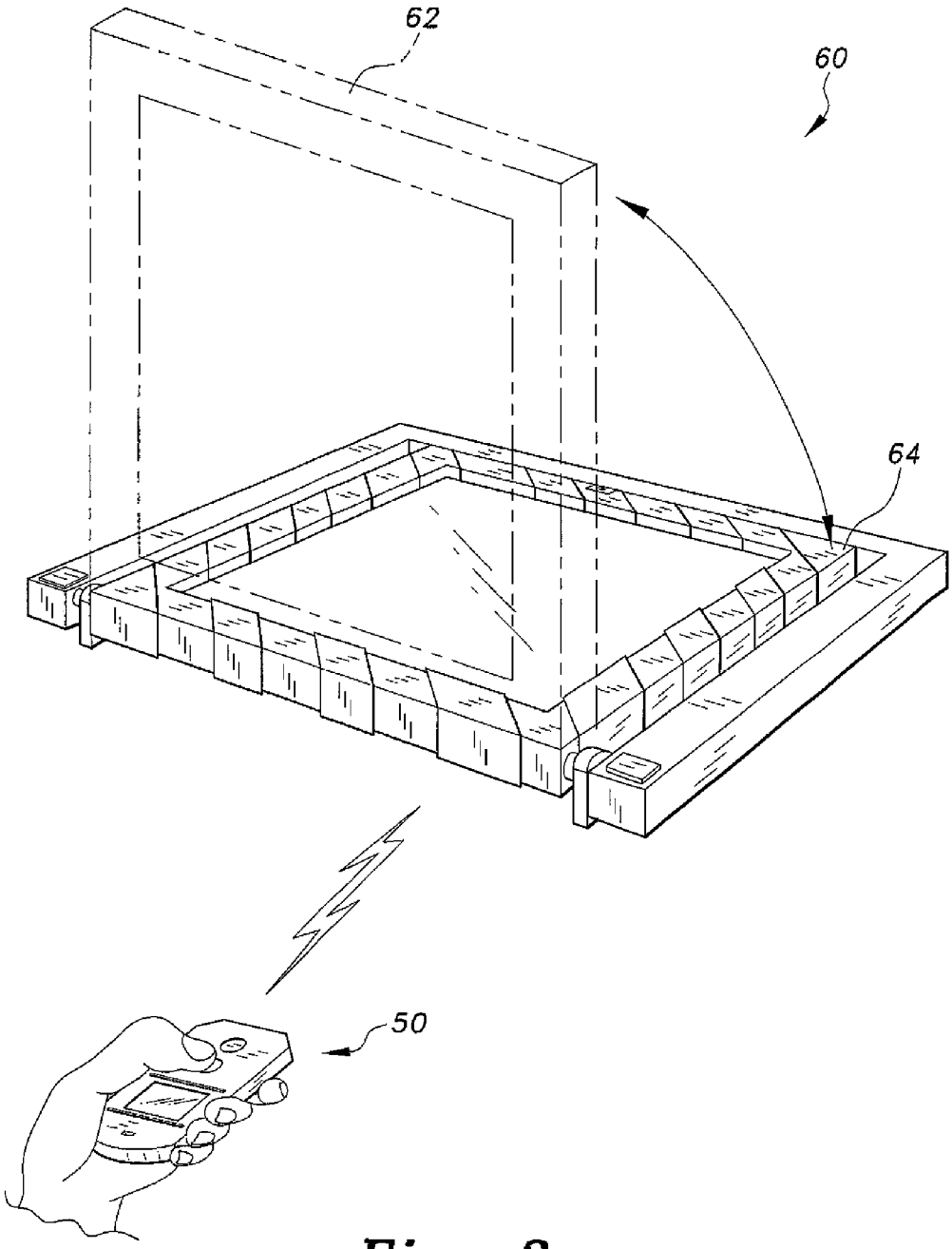
FIG. 3 is a perspective of a system for remote control of retractable, ground-based vehicle barriers according to the present invention, showing the barrier in a lowered position.

Referring to FIG. 3, the system 60 is employing the alternative remote control unit 50 of FIG. 2. As the operator presses the intended button, a radio wave is generated from the remote control unit 50 and is accepted by the receiver 30.

The motor controller circuit 34 then activates the motors 24, and the motors 24 begin to rotate the rod 26. With each revolution of the rotating rod 26, the panel 28 begins to descend from the upright position 62. The panel 28 will continue to descend until it has reached a flat position 64 that is parallel to the street surface and rests within the boundary created by the plurality of frame members. If the user then presses the opposing button on the transmitter 50, a different signal will be generated that will once again activate the motors 24. This time however, the motors 24 will cause the rotating rod 26 to revolve in the opposite direction. The opposite rotation will raise the panel 28 back to the upright position. The panel 28 may have reflecting tape thereon, or may be painted with a reflective or luminous paint, and may have indicia thereon restricting use of the emergency lane to emergency or other authorized vehicles. The panel 28 is sufficiently wide to block traffic when in the vertical position.

Figure 4:
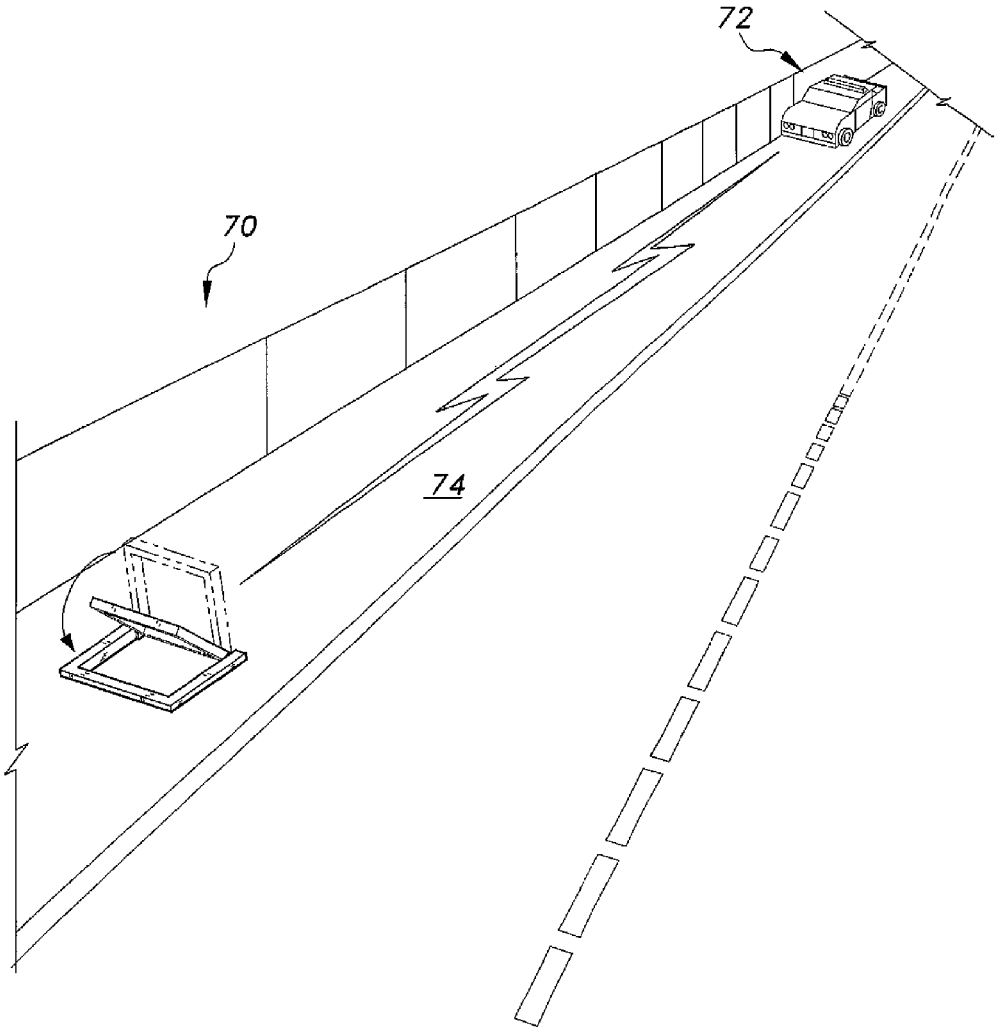
FIG. 4 is an environmental perspective of a system for remote control of retractable, ground-based vehicle barriers according to the present invention.

The system for remote control of retractable, ground-based vehicle barriers may be used in a street environment 70, as shown in FIG. 4. In this scenario an emergency vehicle 72 having a remote control unit mounted thereon is allowed to pass through the barrier that has been placed on an interstate highway emergency lane 74. The emergency vehicle can be a police car, an ambulance, a fire truck, or any other common emergency vehicle. The system 10, 60 itself can be used in a number of settings, such as alleyways, country roads, parking spots, bike paths, etc., or any place that is exposed to vehicular traffic.

Figure 5A:
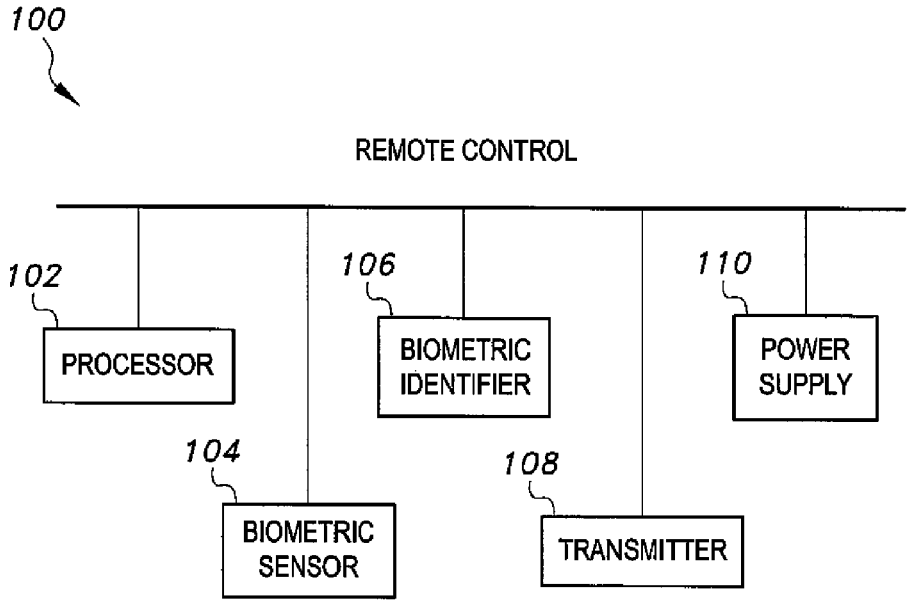
FIG. 5A is a block diagram of a remote control for a system for remote control of retractable, ground-based vehicle barriers according to the present invention.

As shown in FIG. 5A, an exemplary wireless remote control unit 100 may include a processor 102, a transmitter 108 for emitting a wireless signal, and a power supply 110 (e.g., batteries). Optionally, the remote control unit may include a biometric sensor 104 (which may be a fingerprint scanner, whether a touch pad, thermal scanner, or visual image scanner; an eye scanner for scanning the iris or retina; or a microphone for obtaining an audio sample for voiceprint comparison). When equipped with a biometric sensor 104, the remote control unit 100 may also be equipped with a biometric identifier 106 for verifying the identity of the user of the remote control unit 100. In this case, the processor 102 will not activate the transmitter 108 until the biometric identifier 106 verifies the identity of the user. The biometric identifier 106 may be software executing on the processor 102, or may be a dedicated, commercially available integrated circuit configured for the purpose.

Figure 5B:
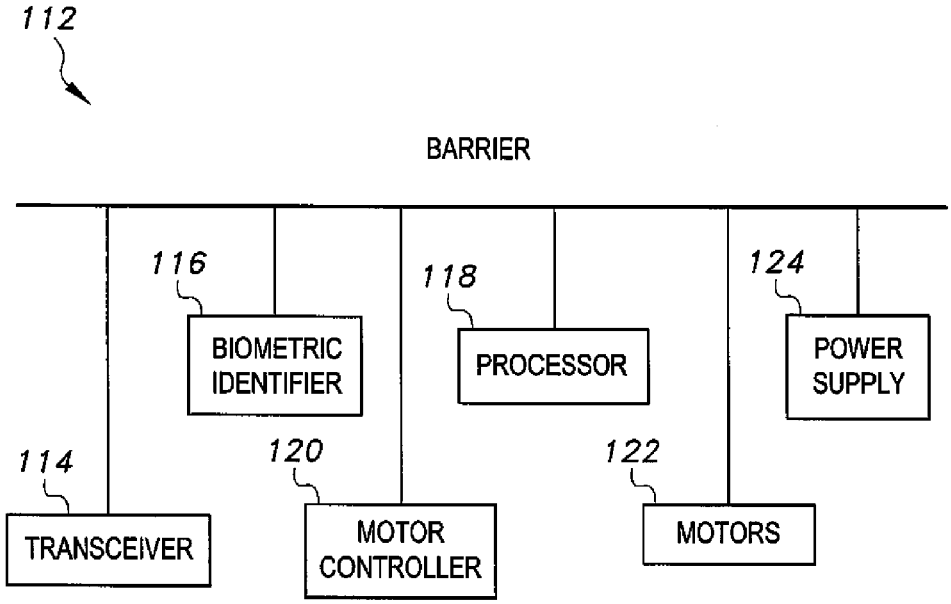
FIG. 5B is a block diagram of the barrier electronics for a system for remote control of retractable, ground-based vehicle barriers according to the present invention.

As shown in FIG. 5B, the signboard barrier 112 may include a transceiver, a motor controller circuit 120, a processor 118, motors for rotating the panel 28, and a power supply, which may be a conventional power supply for variable message signs, or a solar panel mounted on the barrier panel 28 used in conjunction with rechargeable batteries. Optionally, the barrier's electronics may include a biometric identifier 116, as described above, so that the remote control unit 100 might transmit the raw biometric data from the biometric sensor 104, and identification or verification may be performed at the barrier. In this case, the processor 118 would not trigger the motor controller 120 unless the biometric identifier 116 confirms that the remote control unit 100 was activated by an authorized user.

It is to be understood that the present invention is not limited to the embodiments described above, but encompasses any and all embodiments within the scope of the following claims.

I claim:

1. A system for remote control of retractable, ground-based vehicle barriers, comprising:

a remote control unit having a transmitter, a processor, an activation control for causing the processor to activate the transmitter to transmit a control signal, a biometric sensor connected to the processor, and a biometric identifier connected to the processor, the biometric identifier being configured for verifying the identity of a user of the remote control unit from data furnished by the biometric sensor; and wherein processor activates the transmitter upon completion of the verifying the identity of a user;

a plurality of vehicle barriers adapted for spaced apart mounting in an emergency lane of a highway, each of the barriers having:

a frame adapted for mounting in the surface of the emergency lane;

a panel pivotally mounted on the frame, the panel being pivotal between a vertical position blocking vehicle passage in the emergency lane and a horizontal position permitting vehicle passage in the emergency lane;

at least one motor coupled to the frame, the motor being configured for pivoting the panel between the vertical and horizontal positions;

a motor controller connected to the at least one motor;

a transceiver configured to receive the control signal; and a processor connected to the transceiver and to the motor controller, the processor being configured for activating the motor controller to pivot the panel between the vertical and horizontal positions in response to the transceiver receiving the control signal;

wherein the motor controller activates each one of at least one motor of each one of the plurality of barriers in response to the received control signal;

whereby the activation is selectively chosen between sequential and simultaneous.

2. The system for remote control of retractable, ground-based vehicle barriers according to claim 1, wherein the activation control comprises at least one push button control connected to the remote control unit processor.

3. The system for remote control of retractable, ground-based vehicle barriers according to claim 1, wherein the biometric sensor comprises a fingerprint scanner.

4. The system for remote control of retractable, ground-based vehicle barriers according to claim 1, wherein the biometric sensor comprises a retinal scanner.

5. The system for remote control of retractable, ground-based vehicle barriers according to claim 1, wherein the biometric sensor comprises a microphone.

6. The system for remote control of retractable, ground-based vehicle barriers according to claim 1, wherein the barrier further comprises a biometric identifier connected to the barrier processor, the biometric identifier being configured for verifying the identity of a user of the remote control unit from data furnished by the biometric sensor.

7. The system for remote control of retractable, ground-based vehicle barriers according to claim 1, wherein the plurality of vehicle barriers is spaced apart in the emergency lane by a distance between about 100 to 250 meters.

8. A system for controlling access to a vehicle parking space, comprising:

a remote control unit having a transmitter, a processor, and an activation control for causing the processor to activate the transmitter to transmit a control signal, the activation control including a biometric sensor;

wherein the biometric scanner is selected from the group comprising a retinal scanner, a fingerprint scanner, and a microphone; and a vehicle barrier mounting in the parking space, the barrier having:

a frame adapted for mounting in the surface of the parking space;

a panel pivotally mounted on the frame, the panel being pivotal between a vertical position blocking vehicle passage into the parking space and a horizontal position permitting vehicle passage into the parking space;

at least one electric motor coupled to the frame, the motor being configured for pivoting the panel between the vertical and horizontal positions;

a motor controller connected to the at least one electric motor;

a transceiver configured to receive the control signal; and a processor connected to the transceiver and to the motor controller, the processor being configured for activating the motor controller to pivot the panel between the vertical and horizontal positions in response to the transceiver receiving the control signal;

wherein the motor controller activates each of the at least one electric motor in response to the received control signal.

9. The system for controlling access to a vehicle parking space according to claim 8, wherein the remote control unit further comprises a biometric identifier connected to the remote control unit processor, the biometric identifier being configured for verifying the identity of a user of the remote control unit from data furnished by the biometric sensor.

10. The system for controlling access to a vehicle parking space according to claim 8, wherein the barrier further comprises a biometric identifier connected to the barrier processor, the biometric identifier being configured for verifying the identity of a user of the remote control unit from data furnished by the biometric sensor.

11. A method for controlling access to an emergency lane of a highway, comprising the steps of:

mounting a plurality of barriers in the emergency lane, the barriers being spaced apart and pivotal between a vertical position blocking passage in the emergency lane and a horizontal position permitting passage through the emergency lane, the barriers having at least one motor for rotating the barrier and a transceiver connected to the motors; and transmitting a control signal from a remote control unit in an emergency response vehicle to each barrier of the plurality of barriers, each barrier automatically rotating from the vertical position to the horizontal position upon the transceiver receiving the control signal to permit passage of the emergency response vehicle, the rotating of the barriers occurring selectively from sequential and simultaneous;

whereby the emergency lane is selectively reserved for emergency response vehicle passage.

12. The method for controlling access to an emergency lane according to claim 11, further comprising the step of automatically rotating each barrier to the vertical position after passage of the emergency response vehicle successively.

13. The method for controlling access to an emergency lane according to claim 11, further comprising the step of automatically relaying the control signal from one of the barriers to each of the succeeding barriers.

14. The method for controlling access to an emergency lane according to claim 11, wherein the step of mounting a plurality of barriers in the emergency lane including the steps of:

providing each one of the plurality of barriers adapted with a frame adapted for mounting in the surface of the emergency lane, a panel pivotally mounted on the frame, the panel being pivotal between a vertical position blocking vehicle passage in the emergency lane and a horizontal position permitting vehicle passage in the emergency lane, at least one motor coupled to the frame, the motor being configured for pivoting the panel between the vertical and horizontal positions, a motor controller connected to the at least one electric motor, a transceiver configured to receive the control signal, and a processor connected to the transceiver and to the motor controller, the processor being configured for activating the motor controller to pivot the panel between the vertical and horizontal positions in response to the transceiver receiving the control signal; and wherein the step of transmitting a control signal from a remote control unit including the steps of:

providing the remote control unit with a transmitter, a processor, and an activation control for causing the processor to activate the transmitter to transmit the control signal, and a USB port for programmability of the processor.

15. The method for controlling access to an emergency lane according to claim 14, wherein the activation control is connected to the remote control unit processor, and is selected from the group consisting of at least one push button control, and a biometric sensor.

* * * * *